US006993277B2

(12) United States Patent
Nagasaki

(10) Patent No.: US 6,993,277 B2
(45) Date of Patent: Jan. 31, 2006

(54) FIXATION UNIT, THERMAL FIXATION ROLLER, AND RECORDING APPARATUS AND ITS MANUFACTURE METHOD

(75) Inventor: Yoshiki Nagasaki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 23 days.

(21) Appl. No.: 10/795,992

(22) Filed: Mar. 10, 2004

(65) Prior Publication Data

US 2004/0190954 A1 Sep. 30, 2004

(30) Foreign Application Priority Data

Mar. 28, 2003 (JP) ..... 2003-092147

(51) Int. Cl.
*G03G 15/20* (2006.01)

(52) U.S. Cl. ..... 399/320; 399/328

(58) Field of Classification Search ..... 399/328, 399/330, 320, 70
See application file for complete search history.

(56) References Cited

U.S. PATENT DOCUMENTS 5,517,293 A * 5/1996 Tonai et al. ..... 399/331
5,999,789 A * 12/1999 Sawamura ..... 399/330
6,091,926 A * 7/2000 Yamada ..... 399/329

FOREIGN PATENT DOCUMENTS

JP 04-200263 7/1992
JP 10-111615 4/1998
JP 10-267111 10/1998

* cited by examiner

*Primary Examiner*—Diego Gutierrez
*Assistant Examiner*—Tania Courson
(74) *Attorney, Agent, or Firm*—Arent Fox PLLC

(57) ABSTRACT

A fixation unit that fixes toner onto a recording paper includes a thermal fixation roller, a heating part that heats the thermal fixation roller, a compressing part that presses the thermal fixation roller, and a drive gear, mounted on the thermal fixation roller, which rotationally drives the thermal fixation roller, wherein an outer diameter of the thermal fixation roller is equal to or larger than an inner diameter of the drive gear, as the heating part heats the thermal fixation roller.

22 Claims, 6 Drawing Sheets

FIXATION UNIT, THERMAL FIXATION ROLLER, AND RECORDING APPARATUS AND ITS MANUFACTURE METHOD

This application claims the right of priority under 35 U.S.C. §119 based on Japanese Patent Application No. 2003-092147, filed on Mar. 28, 2003, which is hereby incorporated by reference herein in its entirety as if fully set forth herein.

BACKGROUND OF THE INVENTION

The present invention relates generally to a recording apparatus, and more particularly to a structure of a fixation unit in an electrophotographic recording apparatus, such as a laser printer, a copier, and a facsimile machine.

Recent electrophotographic recording apparatuses have been required to be power-saving for ecological purposes as well as fast and inexpensive. Therefore, the electrophotographic recording has a ready-to-print standby mode and a power-saving mode (also referred to as a sleep mode), and transfers to the power-saving mode in the downtime for power saving.

The electrophotographic recording apparatus has a fixation unit that fixes toner through heat and compression. The fixation unit typically includes a hollow cylindrical thermal fixation roller, a halogen lamp, arranged in its longitudinal direction in the hollow part of the thermal fixation roller, which heats up the fixation roller, a rubber roller that contacts and compresses the thermal fixation roller, and a drive gear, mounted around the thermal fixation roller, which rotationally drives the thermal fixation roller. The thermal fixation roller has a notch at its end, whereas the drive gear has a projection. The drive gear is mounted around the thermal fixation roller so that the projection is inserted into the notch. The fixation unit thus structured is relative inexpensive and used for many electrophotographic recording apparatuses.

After a transfer unit that is provided before the fixation unit transfers toner onto a recording paper, the recording paper is heated and compressed while passing between the thermal fixation roller and the rubber roller. As a result, the toner is fused and fixed on the recording paper. As the thermal fixation roller rotates, the recording paper advances between the fixation roller and the rubber rollers. The drive gear applies a drive force to the thermal fixation roller via the projection, and a contact part between the projection and the notch becomes a point of application.

The stress concentrates on the contact part and deforms the notch, resulting in the fatigue crack near the contact part. Accordingly, Japanese Patent Application Publication No. 10-111615 has been proposed a method of dispersing a force applied to the point of application using a layered structure for a thermal fixation roller to prevent the fatigue crack. Other prior art include, for example, Japanese Patent Application Publication No. 10-267111 and Japanese Patent Publication No. 8-10983.

The fixation unit thus has a heating halogen lamp, and consumes the largest power in the recording apparatus. Therefore, the power-saving mode saves the consumed power by turning off the halogen lamp and stopping heating. However, warm-up is needed to light a halogen lamp and heat the fixation roller up to the temperature necessary for printing, when the power-saving mode is returned to the standby mode for printing or at the time of initially power on. The long warm-up time means increased user's waiting time, lowering a user's expectation to fast operations or a customer's satisfaction.

A belt structure fixation method that embeds a ceramic heater into a film has already been known. It is also conceivable to increase an output of the halogen lamp. Although these methods contribute to the shortened warm-up time, the former requires expensive components and the latter is also expensive due to high electric power; they are not preferable in view of a demand for inexpensiveness.

In order to resolve the above problems, the instant inventor has eagerly reviewed instant heating by making the thermal fixation roller as thin as possible to lower its heat capacity. For example, an aluminum thermal fixation roller with a reduced thickness from the conventional thickness of 1.8 mm to 1.0 mm or smaller, for example, about 0.6 mm improves the warm-up time from about 80 seconds to about 20 seconds. However, the thin thermal fixation roller weakens its strength and the above problems become conspicuous. Therefore, repetitive use develops and grows the fatigue crack from the vicinity of the point of application, thereby damaging the thermal fixation roller. As a result, the thermal fixation roller should be replaced and its shorter life than originally expected requires user's economical burden.

BRIEF SUMMARY OF THE INVENTION

Accordingly, it is an exemplified object of the present invention to provide a fixation unit that relatively inexpensively realizes fast operations and ecological demands, a recording apparatus having the same, and its manufacture method.

In order to achieve the above object, a fixation unit of one aspect according to the present invention that fixes toner onto a recording paper includes a thermal fixation roller, a heating part that heats the thermal fixation roller, a compressing part that presses the thermal fixation roller, and a drive gear, mounted on the thermal fixation roller, which rotationally drives the thermal fixation roller, wherein an outer diameter of the thermal fixation roller is equal to or larger than an inner diameter of the drive gear, as the heating part heats the thermal fixation roller. This fixture unit reduces the stress applied by the compressing part to the thermal fixation roller at the time of heating by the heating part by setting the outer diameter of the thermal fixation roller is equal to or larger than the inner diameter of the drive gear. Except for the time of heating by the heating part (for example, at the room temperature), this condition does not have to be satisfied.

Preferably, $0 \leqq A-B \leqq 0.2$ mm is met where A is the outer diameter of the thermal fixation roller and B is the inner diameter of the drive gear. When A−B is smaller than 0, the stress concentration occurs. When A−B is greater than 0.2 mm and, in particular, the thermal fixation roller 210 is made of aluminum or iron, the plastic deformation becomes conspicuous. When the thermal fixation roller is made of aluminum, its thickness is preferably set to be 0.8 mm or smaller, more preferably, 0.6 mm or smaller. Use of such a thin thermal fixation roller makes the warm-up time much shorter than the conventional 1.8 mm thick aluminum thermal fixation roller. The thermal fixation roller has, for example, a temperature between 150° C. and 210° C. as the heating part heats the thermal fixation roller. The outer diameter of the thermal fixation roller may be equal to or larger than the inner diameter of the drive gear at the room temperature. In other words, the fixation unit makes the outer diameter of the thermal fixation unit equal to or larger than the inner diameter of the drive gear at the room temperature or only at the heating time.

A fixation unit of another aspect according to the present invention that fixes toner onto a recording paper includes a hollow thermal fixation roller that has a thickness of 0.6 mm or smaller and is made of a metallic material, a heating part that heats the fixation roller, and a drive gear, mounted on the thermal fixation roller, which rotationally drives the thermal fixation roller. Use of such a thin thermal fixation roller makes the warm-up time much shorter than the conventional 1.8 mm thick aluminum thermal fixation roller.

One of the thermal fixation roller and the drive gear may have a notch and the other may have a projection that can be inserted into the notch. Alternatively, a concave/convex engagement part does not have to exist between the thermal fixation roller and the drive gear, and they may be engaged with each other by a frictional force.

A fixation unit of still another aspect according to the present invention that fixes toner onto a recording paper includes a thermal fixation roller having a projection, a heating part that heats the thermal fixation roller, a compressing part that presses the thermal fixation roller, and a drive gear, mounted on the thermal fixation roller, which rotationally drives the thermal fixation roller and has a notch into which the projection of the thermal fixation roller is inserted. A reverse arrangement between the projection and the notch to the conventional one could reduce an amount of the stress concentration. The thermal fixation roller preferably has a thickness of 0.8 mm or smaller, more preferably, 0.6 mm or smaller. Use of such a thin thermal fixation roller makes the warm-up time much shorter than the conventional 1.8 mm thick aluminum thermal fixation roller.

A recording apparatus of another aspect according to the present invention uses the above one of fixation units to fix toner to the paper through heat and compression, and has a first mode that uses the fixation unit to record information on the recording paper; and a second mode that stop heating the fixation unit. This recording apparatus maintains the ecological performance through the second mode, and uses the above fixation unit for increased strength and smaller thickness of the fixation roller.

A method of another aspect according to the present invention for manufacturing a fixation unit that fixes toner onto a recording paper includes the steps of forming a hollow cylindrical thermal fixation roller that heats and compresses the toner against the recording paper, and has a first thermal expansion coefficient, forming a drive gear that rotationally drives the thermal fixation roller and has a second thermal expansion coefficient smaller than the first thermal expansion coefficient, and mounting the drive gear on the thermal fixation roller, wherein the step of forming the thermal fixation roller and the step of forming the drive gear set an outer diameter of the thermal fixation roller and an inner diameter of the drive gear at the room temperature based on the first and second thermal expansion coefficients so that the outer diameter of the thermal fixation roller is equal to or larger than the inner diameter of the drive gear, when the toner is heated. This method can manufacture a fixation unit that exhibits the above operations. The above fixation roller also constitutes one aspect according to the present invention.

Other objects and further features of the present invention will become readily apparent from the following description of preferred embodiments with reference to the accompanying drawings.

DETAILED DESCRIPTION OF THE PREFERRED EMBODIMENTS

Figure 1:
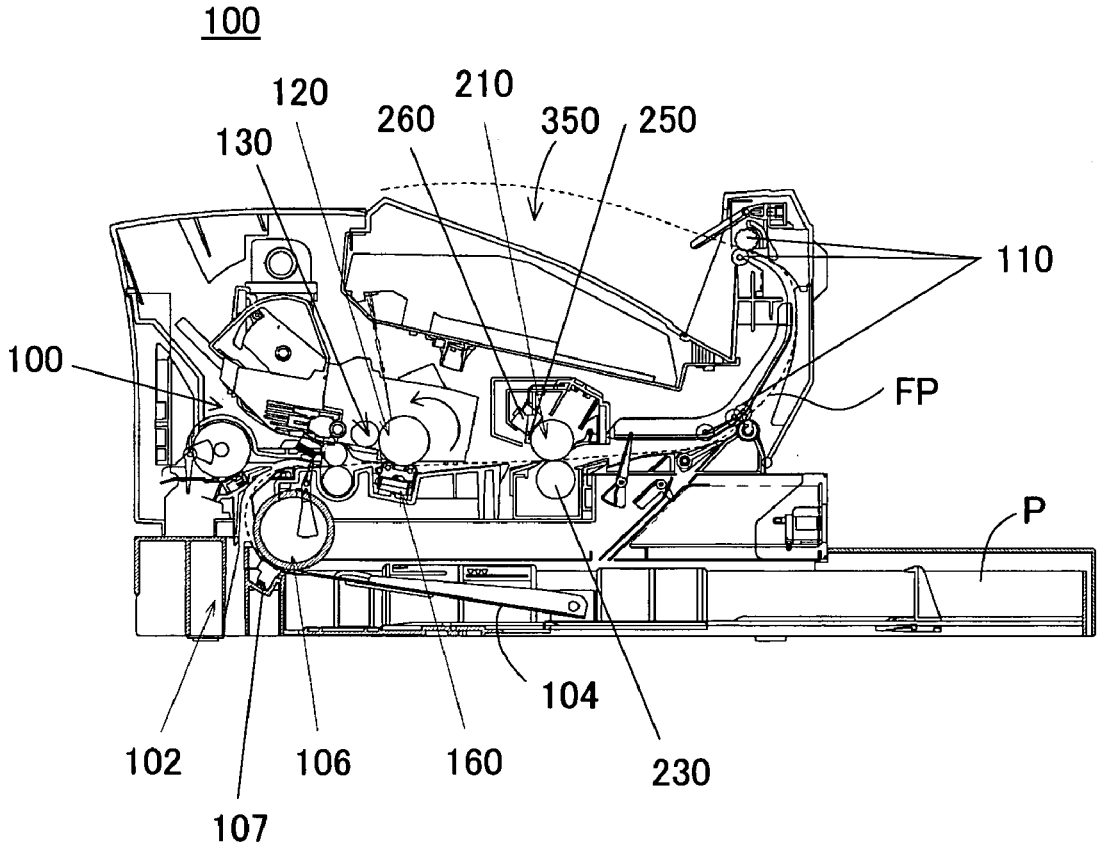
FIG. 1 is a sectional view of a recording apparatus (or a laser printer) of one embodiment according to the present invention.

A description will now be given of a fixation unit or a fixer 200 and a laser printer 100 having the same of one embodiment according to the present invention, with reference to accompanying drawings. Although the instant embodiment uses a laser printer as a typical example of an electrophotographic recording apparatus, the present invention is applicable to a copier and facsimile machine in addition to a single printer. Here, FIG. 1 is a sectional view of the laser printer 100. Although the instant embodiment forms the laser printer 100 as a monochromic printer, the present invention is applicable to a color printer. Although the printer 100 provides single-sided printing the present invention is, of course, applicable to double-sided printing.

The printer 100 includes a sheet introduction section, a sheet conveyor section, a stacker 350, an image-forming unit, and the fixation unit 200.

The sheet introduction section picks up a top paper P in a paper supply cassette 102 that stores plural printing papers P, and supplies it to the sheet conveyor section in the apparatus. The sheet introduction section includes the paper supply cassette 102, the hopper 104, a paper supply roller 106, and a paper separation mechanism 107. The paper supply cassette 102 stores plural papers P. The hopper 104 is forced in an upper direction shown in FIG. 1 by a compression spring, etc., and flips the paper P. The paper supply roller 106 is also referred to as a pickup roller, contacts the top paper P among papers P set in the paper supply cassette 102, and dispenses the paper one by one. The separation mechanism 107 separates one from the drawn papers.

The sheet conveyor section feeds the paper P supplied from the paper introduction part along a sheet feed path FP to the stacker 350 at the top of the apparatus. The paper feed path has various (or driving and driven) sheet feed rollers 110. The paper P is rotated by the sheet feed rollers 110 counterclockwise and dispensed on the stacker 350.

The image-forming unit serves to form (transfer) a desired toner image on the paper P, and includes a photosensitive drum 120, a pre-charger, an exposure unit, a development unit, and a transfer unit 160.

The photosensitive drum 120 as an image holding member includes a photosensitive dielectric layer on a rotatable drum-shaped conductor support. The photosensitive drum 120 applies, for instance, a function separation-type organic photoreceptor with a thickness of about 22 μm on a drum-shaped aluminum member, has an outer diameter of 30 mm, and rotates at a circumferential velocity of 92 mm/s to move in the arrow direction.

The pre-charger includes, for instance, a scorotron charger, and charges a surface of the photosensitive drum 120 at a predetermined potential (e.g., about −600 V). The exposure unit exposes an image on the photosensitive drum 120 and forms a latent image. Any exposure methods known in the art (e.g., the mechanical scanning method and stationary scanning method) can be adopted.

The development unit serves to visualize as a toner image the latent image formed on the photosensitive drum 120. The instant embodiment makes the development unit of a magnet roller 130, blends carrier with magnetic toner near the magnetic roller 130, and charges the toner with predetermined magnetism. This charged toner is electrically adhered to the electrostatic latent image on the photosensitive drum 120 for visualization. The instant embodiment allows the development to include one or two composition (i.e., it may include a carrier), and can use both magnetic and nonmagnetic toners.

The transfer unit 160 has a transfer corotron that generates corona discharges and an electronic field to electrostatically adsorb toner, and electrostatically transfers the toner image adsorbed on the photosensitive drum 120 onto the paper P.

The stacker 350 dispenses the printed paper P.

The fixation unit 200 serves to permanently fix a toner image onto the paper P. Transferred toner is adhered onto the paper P by a weak force, and thus easily fallen off. Therefore, the fixation unit 200 fuses the toner by pressure and heat to imbue the paper P with the toner.

Figure 2:
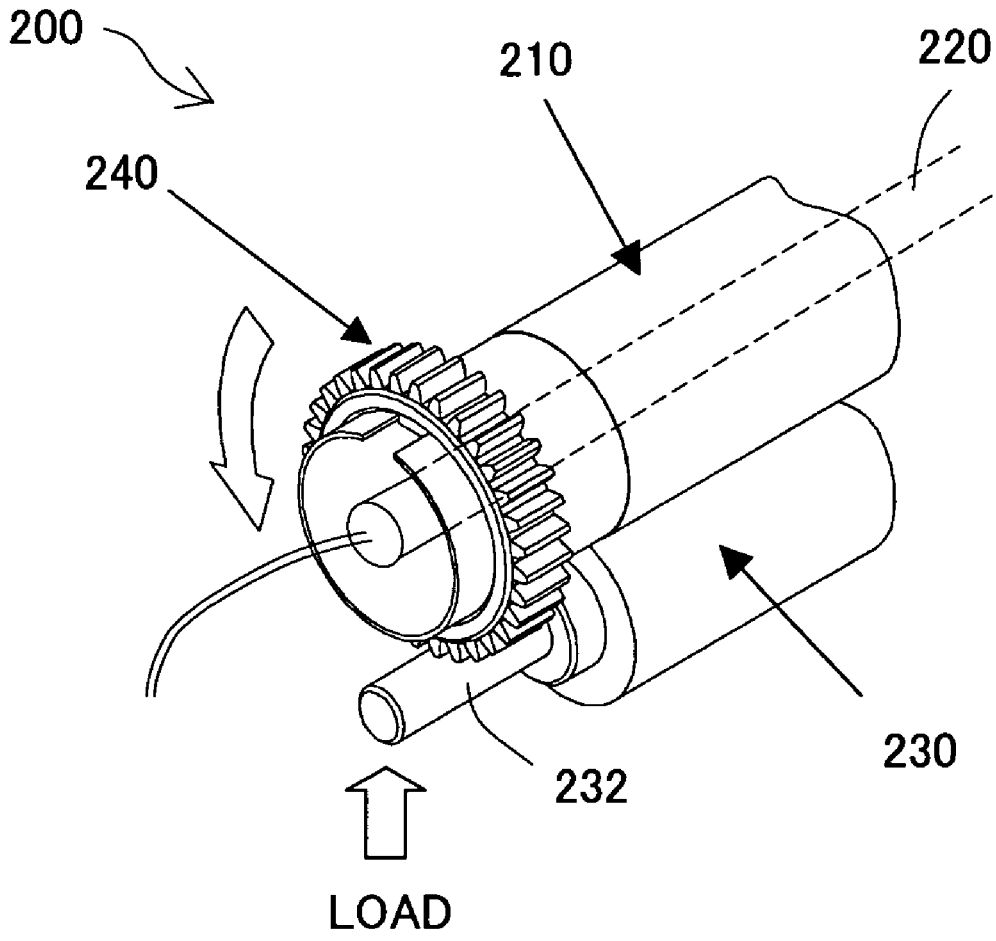
FIG. 2 is a perspective view of principal part of a fixation unit in the recording apparatus shown in FIG. 1.

The fixation unit 200 includes, as shown in FIGS. 1 and 2, a thermal fixation roller 210, a halogen lamp 220, a rubber roller 230, a drive gear 240, a pair of bearings (not shown), a pair of compression springs (not shown), a temperature sensor 250, and a thermostat 260. Here, FIG. 2 is a perspective view of principal part of the fixation unit 200.

Figures 3A, 3B:
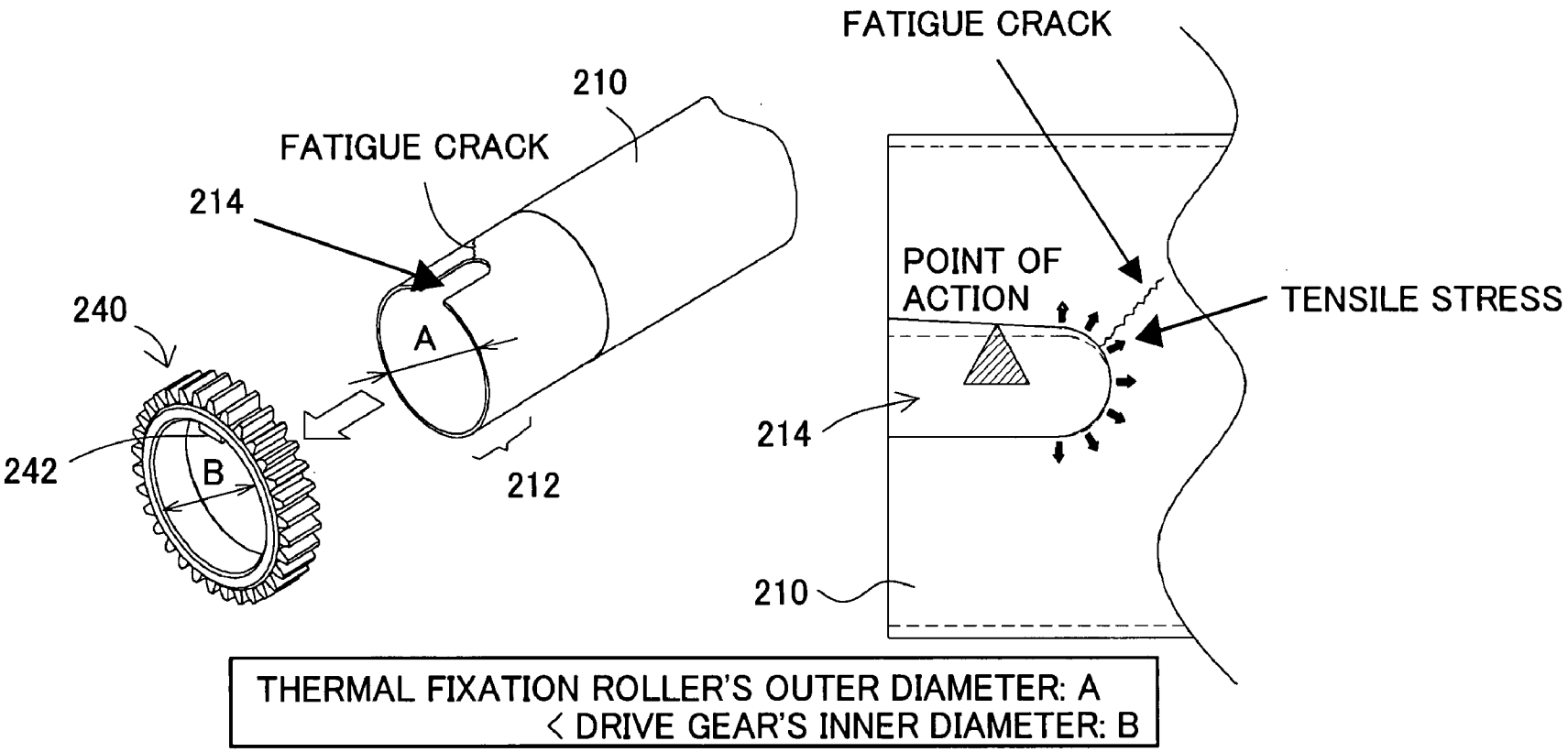
FIGS. 3A and 3B are views for explaining a problem when the fixation unit shown in FIG. 2 has the conventional fit tolerance between a thermal fixation roller and a drive roller.
Figures 4A, 4B:
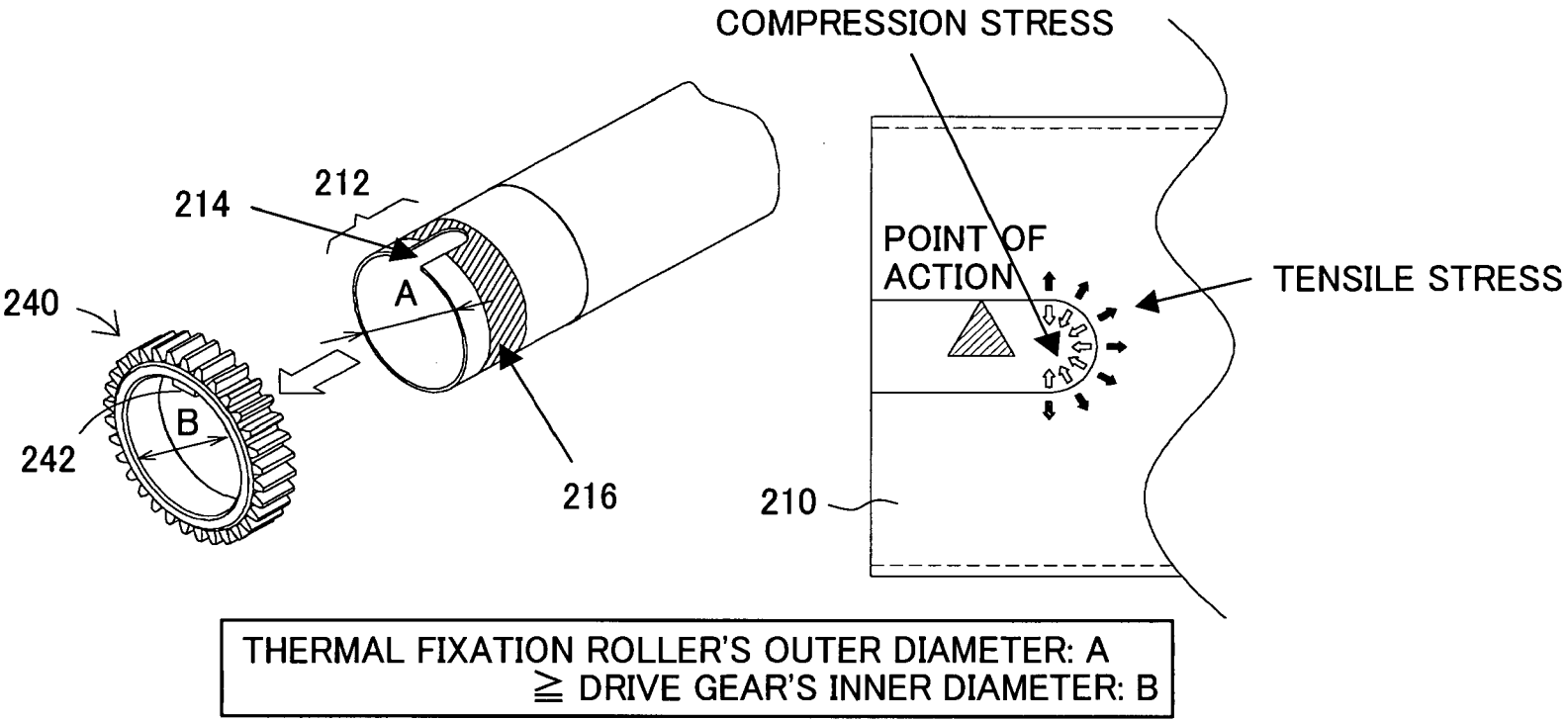
FIGS. 4A and 4B are views for explaining an operation when the fixation unit shown in FIG. 2 has the inventive fit tolerance between the thermal fixation roller and the drive roller.

The thermal fixation roller 210 and the rubber roller 230 are disposed parallel to and in contact with each other, and a nip N is formed therebetween. The thermal fixation roller 210 is made, for example, of aluminum or iron which has a good thermal conductivity, and has a hollow cylindrical shape. As discussed later with reference to FIGS. 3A, 3B, 4A and 4B, the thermal fixation roller 210 has a notch 214 at its end 212. The notch 214 has, as shown in FIG. 4B, a shape similar to a shape similar to a semi-track that has been known to generally mitigate a stress concentration. A surface of the thermal fixation roller 210 is coated and prevents toner from adhering to it.

The instant embodiment makes the fixation roller 210 of aluminum and sets its thickness of 0.8 mm or smaller, preferably 0.6 mm or smaller. Use of such a thin thermal fixation roller makes the warm-up time much shorter than the conventional 1.8 mm thick aluminum thermal fixation roller. More specifically, the warm-up time becomes about 28 seconds for 0.8 mm and about 20 seconds for 0.6 mm.

The thermal fixation roller 210 may use iron and other materials. The iron thermal fixation roller 210 preferably has a thickness of 0.4 mm or smaller, more preferably 0.3 mm or smaller. Use of such a thin thermal fixation roller makes the warm-up time much shorter than the conventional thick aluminum thermal fixation roller. More specifically, the warm-up time becomes about 28 seconds for 0.4 mm and about 20 seconds for 0.3 mm.

The halogen lamp 220 is a longitudinally arranged heat source in a hollow part in the thermal fixation roller 210 to heat the roller 210. The halogen lamp 220 heats the thermal fixation roller 210 at a temperature, for example, between 150° C. and 210° C.

The rubber roller 230 is made, for example, of fluorine-system rubber, silicon rubber or the like. The rubber roller 230 is a driven roller and both ends of its rotary shaft 232 are supported rotatably by the bearing (not shown). A compression spring (not shown) applies a load in an arrow direction shown by FIG. 2 (or a direction from the rubber roller 230 to the thermal fixation roller 210) to a pair of bearings. As shown in FIG. 1, the sheet feed path FP stretches between the thermal fixation roller 210 and the rubber roller 230, and the instant embodiment sets the above load, e.g., about 5 to 7 kg for toner's fixation. The halogen lamp 220's heating and the (not shown) compression spring's pressure make the toner transferred on the paper P at a high temperature and a high pressure, and fix the toner onto the paper P.

The above load applies a torque to the thermal fixation roller 210 as discussed later with reference to FIGS. 3A, 3B, 4A and 4B, especially to the notch 214 in the thermal fixation roller 210.

The drive gear 240 is a hollow cylindrical gear mounted on the thermal fixation roller 210, and rotationally drives the thermal fixation roller 210. For illustration purposes, a gear connected to the drive gear 240, a motor shaft connected to the gear, etc. are omitted.

The instant embodiment makes the drive gear 240 of a material having a smaller thermal expansion coefficient than that of the thermal fixation roller 210, such as brass. As described below, the drive gear 240 preferably has a thermal expansion coefficient different from that of the thermal fixation roller 210. As shown in FIGS. 3A, 3B, 4A and 4B, the drive gear 240 has a projection 242. The drive gear 240 is mounted on the thermal fixation roller 210 so that the projection 242 is inserted into the notch 214 in the thermal fixation roller 210.

The temperature sensor 250 detects a surface temperature of the thermal fixation roller 210. The temperature sensor 250 can apply any temperature sensor known in the art, such as a thermistor thermometer.

The thermostat 260 is a temperature fuse to prevent ignitions, etc. by a compulsory disconnection in case of failure, e.g., when the temperature sensor 250 breaks down.

Figure 5:
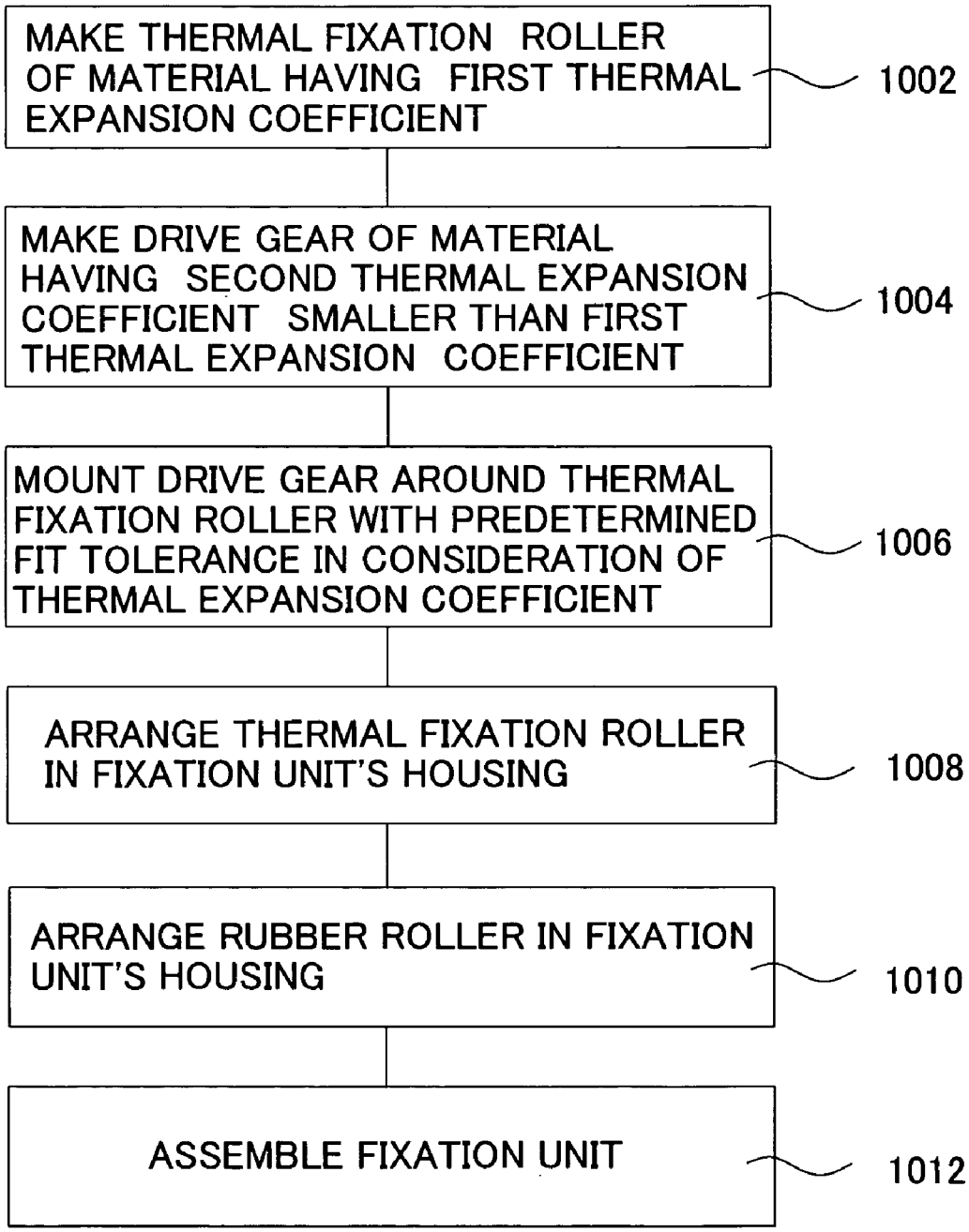
FIG. 5 is a flowchart for explaining a method for manufacture the fixation unit shown in FIG. 2.

A description will be given of a method for manufacturing the fixation unit 200 with reference to FIGS. 3A to 5. Here, FIGS. 3A, 3B, 4A and 4B are views for explaining the fit tolerance between the thermal fixation roller 210 and the drive gear 240 and its effects. More specifically, FIG. 3A shows a perspective view when the thermal fixation roller 210's outer diameter A and the drive gear 240's inner diameter B do not satisfy the condition of the instant embodiment, and FIG. 3B is a typical view showing the stress applied to the thermal fixation roller 210. On the other hand, FIG. 4A shows a perspective view when the thermal fixation roller 210's outer diameter A and the drive gear 240's inner diameter B satisfy the condition of the instant embodiment, and FIG. 4B is a typical view showing the stress applied to the thermal fixation roller 210. FIG. 5 is a flowchart for explaining a method for manufacturing the fixation unit 200.

First, the hollow cylindrical thermal fixation roller 210 is made of a material having a first thermal expansion coefficient (step 1002). The step 1002 makes the thermal fixation roller 210 of aluminum in the instant embodiment. The step 1002 coats the surface of the thermal fixation roller 210 to prevent toner's adhesion.

Next, the hollow cylindrical drive gear 240 is made of a material having a second thermal expansion coefficient smaller than the first thermal expansion coefficient (step 1004). The step 1004 in the instant embodiment makes the drive gear of a sintered material that includes resin, brass, and metal powder.

Next, the drive gear 240 is mounted on the thermal fixation roller 210 (step 1006). These steps 1002 to 1004 set the thermal fixation roller 210's outer diameter A and the drive gear 240's inner diameter B at the room temperature, taking the first and second thermal expansion coefficients into consideration, so that the thermal fixation roller 210's outer diameter A is equal to or larger than the drive gear 240's inner diameter B, more preferably $0 \leqq A-B \leqq 0.2$ mm is met as the halogen lamp 220 heats the thermal fixation roller 210 at a temperature between 150° C. and 210° C.

As discussed above, the load from the compression spring (not shown) generates the torque when the thermal fixation roller 210 rotates, and the tensile stress distributes on the notch 214 in the thermal fixation roller 210, as shown in FIGS. 3B and 4B.

Under $A \leqq B$, the point of application at which the projection 242 contacts the notch 214 becomes substantially one point, as shown in FIG. 3B, at the time of driving (or when the drive gear 240 rotates). As a result, the notch 214 in the thermal fixation roller 210 deforms from a broken line to a solid line in FIG. 3B, and the fatigue crack occurs as shown in FIGS. 3A and 3B.

Even under $A \geqq B$, the point of application at which the projection 242 contacts the notch 214 becomes substantially one point, as shown in FIG. 4B, at the time of driving. However, a physical constraint force applies against the notch 214's stretch, and the compressive stress distributes as shown in FIG. 4B. This compressive stress reduces or cancels out the tensile stress, and prevents a generation of the fatigue crack.

A frictional force occurs between the outer surface of the thermal fixation roller 210 and the inner surface of the drive gear 240. The force that occurs when the thermal fixation roller 210 is driven does not apply only to the notch 214, but disperses over the entire periphery of the thermal fixation roller 210, thereby effectively preventing fatigue cracks due to the stress concentration to the notch 214.

Therefore, as discussed above, $0 \leqq A-B \leqq 0.2$ mm is preferably met. When A−B is smaller than 0, the stress concentration occurs. When A−B greater than 0.2 mm and, in particular, the thermal fixation roller 210 is made of aluminum or iron, the plastic deformation becomes conspicuous.

This condition is met only when the halogen lamp 220 heats the thermal fixation roller 210 or when the thermal fixation roller 210 is at a temperature between 150° C. and 210° C., and the condition may be met or may not be met during the non-heating time, e.g., at the room temperature. In order to satisfy $0 \leqq A-B \leqq 0.2$ mm at the time of assembly, the step 1006 uses, for example, the press fit for the drive gear 240.

From the fact that the step 1006 works at the room temperature, it is preferable that the condition is not meet for easy assembly at the room temperature. As discussed, since the step 1004 makes the drive gear 210 of a material having the second thermal extension smaller than the first thermal extension, a certain difference in thermal expansion can satisfy conditions $A<B$ at the room temperature but $A \geqq B$ at the time of heating.

Figure 6:
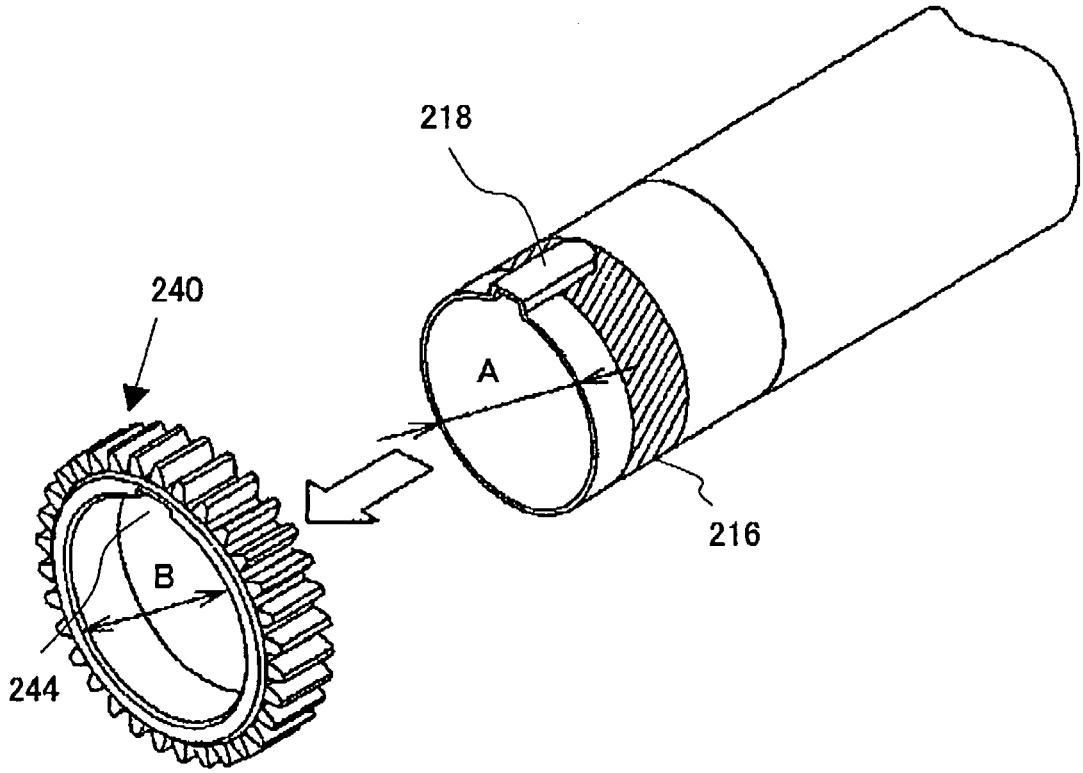
FIG. 6 is a view showing another embodiment of the fixation unit shown in FIG. 4A.

The instant invention provides the thermal fixation roller 210 with the notch 214, and the drive gear 240 with the projection 242. However, the thermal fixation roller 210 may have the projection 218 whereas the drive gear 240 may have a notch as shown in FIG. 6. Here, FIG. 6 shows another embodiment of the fixation unit shown in FIG. 4A. A reverse arrangement of the projection 242 and the notch 214 to the conventional one would change a stress distribution and reduce an amount of the stress concentration. The present invention does not limit a shape of the projection. A concave/convex engagement part does not have to exist between the thermal fixation roller 210 and the drive gear 240. As shown in FIG. 4A, the formed friction-force generation range 216 can drive the thermal fixation roller 210 using a static friction between them.

The halogen lamp 220 is inserted into the hollow part in the thermal fixation roller 210, and the thermal fixation roller 210 is attached in a first housing (not shown) of the fixation unit 200, to which the temperature sensor 250 and the thermostat 260 have been attached (step 1008). Parallel to the steps 1002 to 1008, the rubber roller 230 is attached to a second housing of the fixation unit 200 through the bearings, and the load by the compression spring is applied to the bearings. Thereafter, the first and second housing are arranged opposite to each other, and the fixation unit 200 is assembled as shown in FIG. 2.

A description will be given of operations of the printer 100. The printer 100 of the instant embodiment has two modes, i.e., a standby mode and a power-saving mode (or a sleep mode). The standby mode uses the fixation unit 200 to fixes toner onto the recording paper through heat and compression, and record information on the paper P. The power-saving mode stops heating by the halogen lamp 220 in the fixation unit 200. The printer 100 transfers to a standby mode when supplied with power or receiving a print instruction, but automatically switches from the standby mode to the power-saving mode when it does not receive a print instruction for a certain time of period. A controller (not shown) controls the switching action. The power-saving mode allows the printer to save power and to improve ecological performance.

On the other hand, when supplied with power or receiving a print instruction, the controller switches to the standby mode and starts warm-up. During the warm-up time, the halogen lamp 220 heats up the fixation roller 210. The controller determines whether the temperature of the thermal fixation roller 210 reaches the predetermined temperature (for example, about 130° C.) based on information form the temperature sensor 250.

As discussed, the fixation unit 200 fixes the toner onto the paper P by heat and compression, and the low temperature of the fixation roller 210 cannot fuse the toner sufficiently. The instant embodiment sets the thickness of the aluminum thermal fixation roller 210 to be 0.8 mm or smaller, preferably 0.6 mm or smaller, and the warm-up time becomes 30 seconds or shorter, preferably 20 seconds or shorter, which is equal to or shorter than half the warm-up time (about 80 seconds) of the conventional aluminum 1.8 mm thick thermal fixation roller 210, meeting the user's expectation of fast actions.

In printing, a top paper P among papers P set in the paper supply cassette 102 is dispensed out by the paper supply pickup roller 212, and guided to the sheet feed path FP. Thereafter, the image-forming unit forms a toner image on the paper P, and passes it to the fixation unit 200. The fixation unit 200 feeds the paper P as the drive gear 240 rotationally drives the thermal fixation roller 210. When the paper P is fed, the thermal fixation roller 210 compresses and heats the toner on the recording paper P to fix the toner onto the paper P. The fixed paper P is dispensed out to the stacker 350.

In the thermal fixation roller 210 of the instant embodiment, the small stress concentration applied at the time of rotational driving is sufficiently small in view of the strength of the thermal fixation roller 210 and no fatigue cracks occur. Therefore, the thermal fixation roller 210 does not get damaged even when the drive gear 240 continuously drives the roller 210, and can complete an expected life (e.g., a period for which the surface coating is worn away due to a friction with the paper). The thermal fixation roller 210 has a life as long as the conventional thick thermal fixation roller, and does not cause excessive user's economical burden.

The fixation unit 200 of the instant embodiment is exchangeable with the conventional fixation unit in the conventional electrophotographic recording apparatus, and has an independent economical asset. However, this exchanges needs a replacement of firmware for the controller that controls each components including the paper introduction section, the paper feed section, the image-forming unit, and the fixation unit. For example, if the temperature sensor 250 does not inform that the temperature of the thermal fixation roller 210 reaches the predetermined temperature within a predetermined period after the controller lights the halogen lamp 220 and starts the warm-up, a warning is indicated on a display (not shown) or a warning lamp is lit on the printer 100 so as to warn an abnormal action of the halogen lamp 220: The fixation unit 200 of the instant embodiment makes this predetermined period shorter than the conventional one.

Further, the present invention is not limited to these preferred embodiments, and various variations and modifications may be made without departing from the scope of the present invention. For example, there is provided a structure that prevents the notch 214's stretch after the drive gear 240 is mounted on the thermal fixation roller 210, as shown in FIG. 3A. Such a structure is, for example, a suspension member that closes the notch and is arranged across the notch 214. The attachment can use a known method in the art, such as a screw and a bolt. This suspension member prevents a deformation of the notch 214 shown by a solid line in FIG. 3B, and maintains a state shown by a broken line, reducing the fatigue crack.

Thus, the present invention can provide a fixation unit that relatively inexpensively realizes fast operations and ecological demands, a recording apparatus having the same, and its manufacture method.

What is claimed is:

1. A fixation unit that fixes toner onto a recording paper, said fixation unit comprising:

a thermal fixation roller;

a heating part that heats said thermal fixation roller;

a compressing part that presses said thermal fixation roller; and a drive gear, mounted on said thermal fixation roller, which rotationally drives said thermal fixation roller, said drive gear being made of a material having a coefficient of thermal expansion that is less than that of said thermal fixation roller, wherein an outer diameter of said thermal fixation roller is equal to or larger than an inner diameter of said drive gear, as said heating part heats said thermal fixation roller.

2. A fixation unit according to claim 1, wherein $0 \leqq A-B \leqq 0.2$ mm is met where A is the outer diameter of the thermal fixation roller and B is the inner diameter of the drive gear.

3. A fixation unit according to claim 1, wherein said thermal fixation roller has a temperature between 150° C. and 210° C. as said heating part heats said thermal fixation roller.

4. A fixation unit according to claim 1, wherein the outer diameter of said thermal fixation roller is equal to or larger than the inner diameter of said drive gear during a non-heating time of said heating part.

5. A fixation unit according to claim 1, wherein one of said thermal fixation roller and said drive gear has a notch and the other has a projection that can be inserted into the notch.

6. A fixation unit according to claim 1, wherein a frictional force engages said thermal fixation roller with said drive gear.

7. A fixation unit according to claim 1, wherein said thermal fixation roller is made of aluminum and has a thickness of 0.8 mm or smaller.

8. A fixation unit according to claim 1, wherein said thermal fixation roller is made of aluminum and has a thickness of 0.6 mm or smaller.

9. A fixation unit according to claim 1, wherein said thermal fixation roller has a hollow cylindrical shape.

10. A fixation unit that fixes toner onto a recording paper, said fixation unit comprising:

a hollow thermal fixation roller that has a thickness of 0.6 mm or smaller and is made of a metallic material;

a heating part that heats said fixation roller; and a drive gear, mounted on said thermal fixation roller, which rotationally drives said thermal fixation roller, said drive gear being made of a material having a coefficient of thermal expansion that is less than that of said thermal fixation roller.

11. A fixation unit according to claim 10, wherein the metallic material is aluminum.

12. A fixation unit that fixes toner onto a recording paper, said fixation unit comprising:

a thermal fixation roller having a projection;

a heating part that heats said thermal fixation roller;

a compressing part that presses said thermal fixation roller; and a drive gear, mounted on said thermal fixation roller, which rotationally drives said thermal fixation roller and has a notch into which the projection of said thermal fixation roller is inserted, said drive gear being made of a material having a coefficient of thermal expansion that is less than that of said thermal fixation roller.

13. A fixation unit according to claim 12, wherein said thermal fixation roller is made of aluminum and has a thickness of 0.8 mm or smaller.

14. A fixation unit according to claim 12, wherein said thermal fixation roller is made of aluminum and has a thickness of 0.6 mm or smaller.

15. A recording apparatus comprising:

a fixation unit that fixes toner onto a recording paper, wherein said fixation unit includes a thermal fixation roller, a heating part that heats said thermal fixation roller, a compressing part that presses said thermal fixation roller, and a drive gear, mounted on said thermal fixation roller, which rotationally drives said thermal fixation roller, said drive gear being made of a material having a coefficient of thermal expansion that is less than that of said thermal fixation roller, wherein an outer diameter of said thermal fixation roller is equal to or larger than an inner diameter of said drive gear, as said heating part heats said thermal fixation roller;

a first mode that uses said fixation unit to record information on the recording paper; and a second mode that stop heating said fixation unit.

16. A recording apparatus comprising:

a fixation unit that fixes toner onto a recording paper, wherein said fixation unit includes a hollow thermal fixation roller that has a thickness of 0.6 mm or smaller and is made of metallic material, a heating part that heats said fixation roller, and a drive gear, mounted on said thermal fixation roller, which rotationally drives said thermal fixation roller, said drive gear being made of a material having a coefficient of thermal expansion that is less than that of said thermal fixation roller;

a first mode that uses said fixation unit to record information on the recording paper; and a second mode that stop heating said fixation unit.

17. A recording apparatus comprising:

a fixation unit that fixes toner onto a recording paper, wherein said fixation unit includes a thermal fixation roller having a projection, a heating part that heats said thermal fixation roller, a compressing part that presses said thermal fixation roller, and a drive gear, mounted on said thermal fixation roller, which rotationally drives said thermal fixation roller and has a notch into which the projection of said thermal fixation roller is inserted, said drive gear being made of a material having a coefficient of thermal expansion that is less than that of said thermal fixation roller;

a first mode that uses said fixation unit to record information on the recording paper; and a second mode that stop heating said fixation unit.

18. A method for manufacturing a fixation unit that fixes toner onto a recording paper, said method comprising the steps of:

forming a hollow cylindrical thermal fixation roller that heats and compresses the toner against the recording paper, and has a first thermal expansion coefficient;

forming a drive gear that rotationally drives the thermal fixation roller and has a second thermal expansion coefficient smaller than the first thermal expansion coefficient; and mounting the drive gear on the thermal fixation roller, wherein said step of forming the thermal fixation roller and said step of forming the drive gear set an outer diameter of the thermal fixation roller and an inner diameter of the drive gear during a time of non-heating based on the first and second thermal expansion coefficients so that the outer diameter of said thermal fixation roller is equal to or larger than the inner diameter of said drive gear, when the toner is heated.

19. A thermal fixation roller on which a drive gear is mounted, said thermal fixation roller comprising a body having an outer diameter equal to or larger than an inner diameter of the drive gear at the time of heating, said drive gear being made of a material having a coefficient of thermal expansion that is less than that of said thermal fixation roller.

20. A thermal fixation roller according to claim 19, wherein said thermal fixation roller has a hollow cylindrical shape.

21. A thermal fixation roller according to claim 19, wherein said thermal fixation roller is made of a metallic material and has a thickness of 0.6 mm or smaller.

22. A thermal fixation roller according to claim 19, wherein the metallic material is aluminum.

* * * * *